US009865920B1

(12) United States Patent
Kuo et al.

(10) Patent No.: US 9,865,920 B1
(45) Date of Patent: Jan. 9, 2018

(54) ANTENNA ISOLATION IN A MULTI-BAND ANTENNA SYSTEM

(71) Applicant: Amazon Technologies, Inc., Reno, NV (US)

(72) Inventors: Jerry Weiming Kuo, San Jose, CA (US); Ming Zheng, Cupertino, CA (US); Jay William Kruse, Los Gatos, CA (US)

(73) Assignee: Amazon Technologies, Inc., Reno, NV (US)

( * ) Notice: Subject to any disclaimer, the term of this patent is extended or adjusted under 35 U.S.C. 154(b) by 662 days.

(21) Appl. No.: 14/470,713

(22) Filed: Aug. 27, 2014

(51) Int. Cl.
*H01Q 5/00* (2015.01)
*H01Q 21/28* (2006.01)
*H01Q 1/52* (2006.01)

(52) U.S. Cl.
CPC ..... *H01Q 5/0034* (2013.01); *H01Q 1/523* (2013.01); *H01Q 21/28* (2013.01)

(58) Field of Classification Search
None
See application file for complete search history.

(56) References Cited

U.S. PATENT DOCUMENTS 6,624,789 B1 * 9/2003 Kangasvieri ..... H01Q 1/243 343/702
2013/0335290 A1 * 12/2013 Desclos ..... H01Q 21/28 343/853

OTHER PUBLICATIONS

Chen et al., "A Decoupling Technique for Increasing the Port Isolation Between Two Strongly Coupled Antennas"; IBEE Transactions on Antennas and Propagation, vol. 56, No. 12, Dec. 2008.
Jiang et al. "Dual-Band Coupling Element Based Antennas with High Port Isolation", Progress in Electromagnetics Research Letters, vol. 37, 91-99, 2013.

* cited by examiner

*Primary Examiner* — Graham Smith
(74) *Attorney, Agent, or Firm* — Lowenstein Sandler LLP

(57) ABSTRACT

An apparatus includes a first reactive component coupled between a first antenna and a second antenna in a multi-band antenna system. The apparatus further includes a first operation circuit coupled to the first reactive component. The first reactive component and the first operation circuit together form a signal path to enable signal flow between the first and the second antennas when the first and the second antennas are operating at a first frequency. The first operation circuit disables signal flow along the signal path when the first and the second antennas are operating at a second frequency.

18 Claims, 14 Drawing Sheets

ANTENNA ISOLATION IN A MULTI-BAND ANTENNA SYSTEM

BACKGROUND

Users enjoy entertainment through the consumption of media items, including electronic media, such as electronic books (also referred to herein as ebooks), electronic newspapers, electronic magazines, other electronic publications, audio books, and digital video. Users employ various electronic devices to consume such media items. Among these electronic devices are electronic book readers, cellular telephones, personal digital assistants (PDAs), portable media players, tablet computers, electronic pads, netbooks, desktop computers, notebook computers, and the like. These electronic devices wirelessly communicate with a communications infrastructure to enable the consumption of the digital media items. In order to wirelessly communicate with other devices, these electronic devices include one or more antennas.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
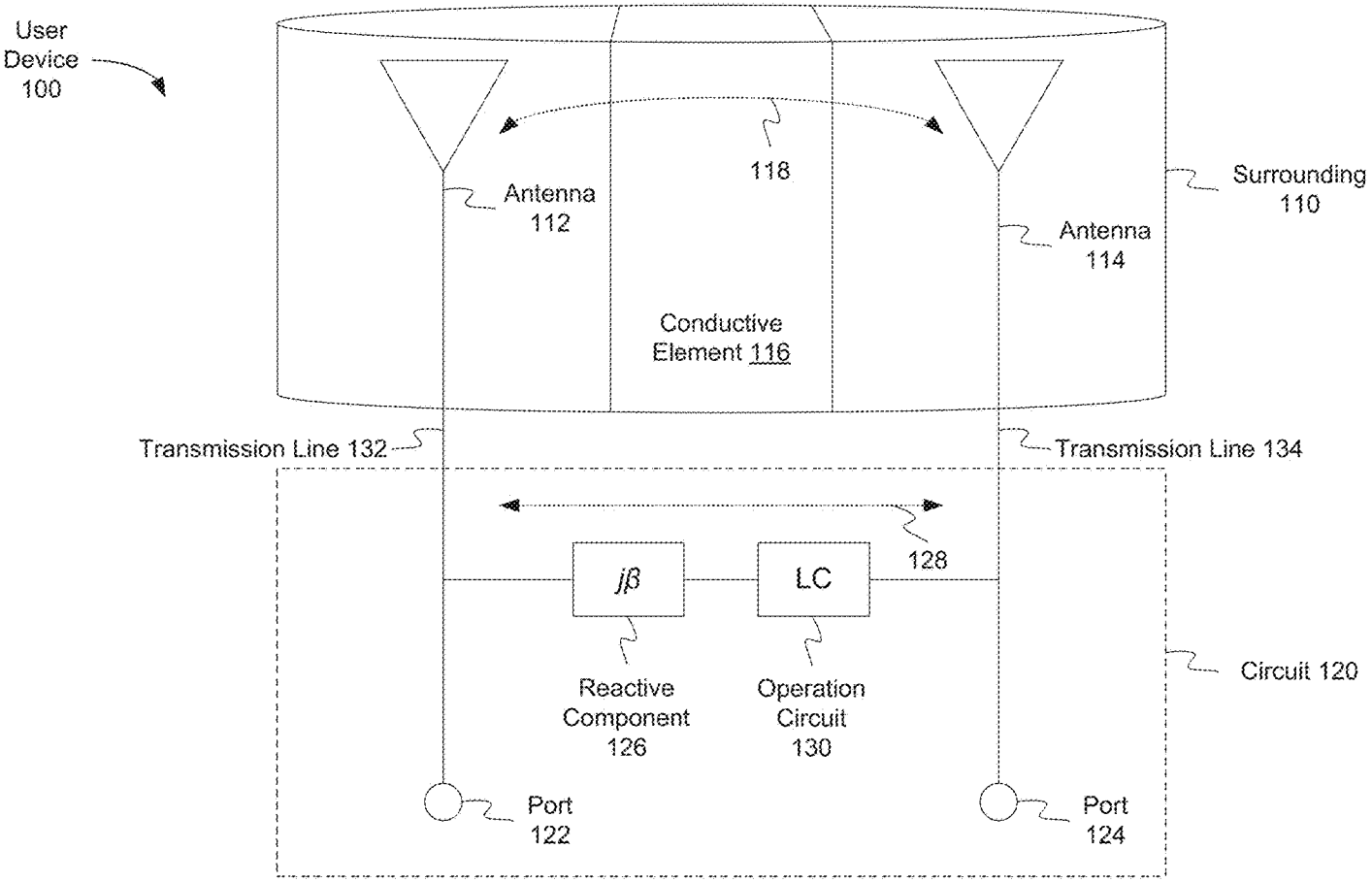
FIG. 1 is a diagram illustrating a circuit for improving antenna isolation in a user device with a multi-band antenna system, according to an embodiment.

Embodiments are described for improving antenna isolation in a multi-band antenna system. As wireless communication technology evolves, there is a need in modern systems to achieve higher data rates than conventional systems can provide. One technique includes the use of a multiple antennas in a single device. Multiple-input and multiple-output (MIMO) systems use multiple antennas at both the transmitter and receiver to communicate wireless signals with improved performance. MIMO technology provides increases in data throughput without requiring additional bandwidth or increased power usage. MIMO systems achieve this goal by spreading the same total transmit power over multiple antennas to achieve an array gain that improves spectral efficiency and diversity gain.

One potential drawback of using a multiple antenna system is the possibility of signal coupling between the antennas. There is constant market pressure to decrease the size of modern communication devices (e.g., tablet computers, smart phones, electronic book readers) while increasing the electronic components contained therein. Thus, when multiple antennas are added into a compact space in a communication device, achieving antenna isolation can be difficult. Low isolation, due to close proximity of the antennas, can introduce signal leakage from one antenna to the other, thereby increasing signal correlation between communication channels. Depending on the system, it may be preferred to have isolation of at least 10 dB and envelope correlation coefficients (E.C.C.) of less than 0.5. On technique of improving isolation (i.e., reducing energy leakage from one communication port to another and maintaining antenna efficiency) between antennas is increasing the physical distance between antennas. Size constraints on devices, however, make physical separation practical only to a certain extent. Furthermore, even when antennas are separated by sufficient distance, it is possible that some conductive element is present in proximity to both antennas. For example, there may be a protective cover surrounding both antennas, or some other conductive element that is located between the two antennas. The signals from each antenna may drive current through the conductive element in opposite directions, resulting in signal coupling between the antennas via an over-the-air signal path when the antennas are operating at a certain frequency. A radio frequency (RF) signal along this over-the-air signal path may have a first phase and may decrease the antenna isolation achieved by the physical separation of the antennas.

In one embodiment, in order to reduce coupling between antennas that are either located physically close to one another or have a conductive element in proximity to both, the antenna system may include a reactive component coupled between the two antennas that serves as a shunt allowing current to pass between the antennas. The antennas may experience coupling to one another through the radiations over the air. To negate this coupling, the reactive component (or set of reactive components) and the corresponding transmission lines may be designed to create a second signal path for a second signal to flow between the antennas when the antennas are operating at the first frequency. This second signal may have a second phase that is 180 degrees offset (i.e., an opposite phase) of the first phase from the over-the-air signal. In one embodiment, these two signals with opposite phases cancel each other out, in order to reduce coupling and improve antenna isolation. The design of the reactive component may only be effective at improving isolation at one frequency band, however. For example, the value of an inductor or capacitor in the reactive component, and the length of the transmission lines between the reactive component and the antennas may be specifically designed to reduce coupling at a certain frequency. When the multiple antenna system is designed to operate in multiple frequency bands, however, while the reactive component may improve isolation and lower the E.C.C. at one frequency, it may not be effective at other frequencies. In some cases, the reactive component may even make the isolation and E.C.C. worse at other frequencies than if no reactive component were present.

Accordingly, in one embodiment, the antenna system may include the reactive component designed to improve isolation at a first frequency and an operation circuit designed to enable the reactive component only when the antennas are operating at the first frequency and to disable the reactive component when the antennas are operating at other frequencies. Together, the reactive component and the operation circuit form the second signal path for the signal between the antennas with a phase that is 180 degrees offset from the phase of the over-the-air signal. For example, the operation circuit may include a filter (e.g., a low-pass filter, high-pass filter, band-stop filter or band-pass filter) that enables signal flow through the reactive component in certain frequency bands and disables signal flow in others. In another embodiment, the operation circuit may include a switch that can be closed to allow signal flow through the reactive component at certain times (e.g., during periods of operation at a given frequency) and opened to prevent signal flow at other times. In this manner, the reactive component is only enabled when the antennas are operating at the frequency for which the reactive component is designed to improve isolation and can be disabled at all other frequencies, so as not to negatively affect the antenna isolation at those frequencies.

In one embodiment, the antenna system may include multiple reactive components, where each reactive component is designed to reduce signal coupling at a different frequency. Each reactive component may have a corresponding operation circuit designed to enable the reactive component only when the antennas are operating at the frequency for which the corresponding reactive component was designed. In this manner, antenna isolation and E.C.C. can be improved at each of the various different frequencies for which the multi-band antenna system is designed to operate. In another embodiment, each reactive component and its corresponding operation circuit can be combined to be part of a single circuit. For example, if the reactive component is a capacitor, the reactive component could be combined with another capacitor in the operation circuit by reducing the capacitance value of the reactive component. Similarly, if the reactive component is an inductor, the reactive component could be combined with another inductor in the operation circuit by increasing the inductance value of the reactive component. This combination can improve the elegance of the circuit design, thereby saving space in the circuit and reducing manufacturing costs.

FIG. 1 is a diagram illustrating a circuit for improving antenna isolation in a user device with a multi-band antenna system, according to an embodiment. In one embodiment, a user device 100 includes a multi-antenna system having at least two antennas 112 and 114. User device 100 may be any type of computing device including an electronic book reader, a PDA, a mobile phone, a laptop computer, a portable media player, a tablet computer, an electronic pad, a desktop computer, a camera, a video camera, a netbook, or similar computing device. User device 100 may be variously configured with different features to enable wireless data communication using antennas 112 and 114. Antennas 112 and 114 may provide network connectivity using any type of mobile network technology including, for example, cellular digital packet data (CDPD), general packet radio service (GPRS), enhanced data rates for GSM evolution (EDGE), universal mobile telecommunications system (UMTS), 1 times radio transmission technology (1×RTT), evaluation data optimized (EVDO), high-speed downlink packet access (HSDPA), WiFi, etc.

In one embodiment, antennas 112 and 114 are at least partially contained within antenna surrounding 110. Antenna surrounding 110 may be a protective cover designed to prevent damage to antennas 112 and 114, part of an exterior casing of user device 100, or some other surrounding element. In one embodiment, antenna surrounding 110 includes at least one conductive element 116 in proximity to both of antennas 112 and 114. In one embodiment, the physical distance between antennas 112 and 114 may be large enough to provide sufficient antenna isolation (e.g., greater than 10 dB) to prevent signal coupling between antennas 112 and 114, were conductive element 116 not present. The physical distance between each of antennas 112 and 114 and conductive element 116, however, may be short enough that signals from each antenna 112 and 114 may drive current through the conductive element 116 in opposite directions, resulting in signal coupling between antennas 112 and 114 via an over-the-air signal path 118 when the antennas are operating at a certain frequency (e.g., 2.4 GHz). An RF signal along over-the-air signal path 118 may have a first phase and decrease the antenna isolation achieved by the physical separation of antennas 112 and 114. In another embodiment, where conductive element 116 may or may not be present, the physical distance between antennas 112 and 114 may be small enough, such that there is insufficient antenna isolation (e.g., less than 10 dB) and over-the-air signal path 118 still exists.

In one embodiment, each antenna 112 and 114 is coupled to a corresponding signal port 122 and 124 in circuit 120 via a transmission line 132 and 134. Each antenna 112 and 114 may communicate transmission signals to and from the corresponding signal port 122 and 124 at multiple different frequencies. For ease of explanation, it can be assumed that antennas 112 and 114 will operate at either a low frequency (e.g., 2.4 GHz) or a high frequency (e.g., 5 GHz). It should be understood however, that these frequencies are merely examples, and that in other embodiments antennas 112 and 114 may operate at different frequencies or at more than two different frequencies.

In one embodiment, circuit 120 includes reactive component 126, coupled between antennas 112 and 114, and operation circuit 130, coupled to reactive component 126. Reactive component 126 and operation circuit 130 may form a second signal path 128 for a second signal to flow between antennas 112 and 114 when antennas 112 and 114 are operating at the first frequency (e.g., 2.4 GHz). This second signal may have a second phase that is 180 degrees offset (i.e., an opposite phase) of the first phase from the over-the-air signal path 118. Together, reactive component 125 and operation circuit 130 serve as a shunt allowing current to pass between antennas 112 and 114, thereby reducing coupling and improving isolation between antennas 112 and 114. In one embodiment, the two signals from over-the-air path 118 and path 128 have opposite phases and cancel each other out, in order to reduce the signal coupling. Depending on the embodiment, the reactive component may comprise an inductor, a capacitor, or some combination of inductors and capacitors. The values of inductors or capacitors, as well as the lengths of transmission lines 132 and 134 that couple reactive component 126 to antennas 112 and 114, may be designed to improve isolation at a certain frequency (e.g., 2.4 GHz). Antennas 112 and 114 may transmit and receive signals at various different frequencies (e.g., 5 GHz), however, and the design of reactive component 126 may not be effective at improving antenna isolation at those frequencies. In some cases, the reactive component 126 may even decrease the isolation at other frequencies.

Accordingly, in one embodiment, operation circuit 130 is designed to enable reactive component 126 only when antennas 112 and 114 are operating at a certain frequency (e.g., 2.4 GHz) and to disable the reactive component when the antennas are operating at other frequencies (e.g., 5 GHz). For example, operation circuit 130 may include a filter or switch that enables signal flow through reactive component 126 in certain frequency bands and disables signal flow in others. Operation circuit 130 enables reactive component 130 only when antennas 112 and 114 are operating at the frequency for which reactive component 126 is designed to improve isolation and can be disabled at all other frequencies, so as not to potentially decrease the antenna isolation at those other frequencies. Additional details of operation circuit 130 are discussed below with respect to FIGS. 2-5.

Figure 2:
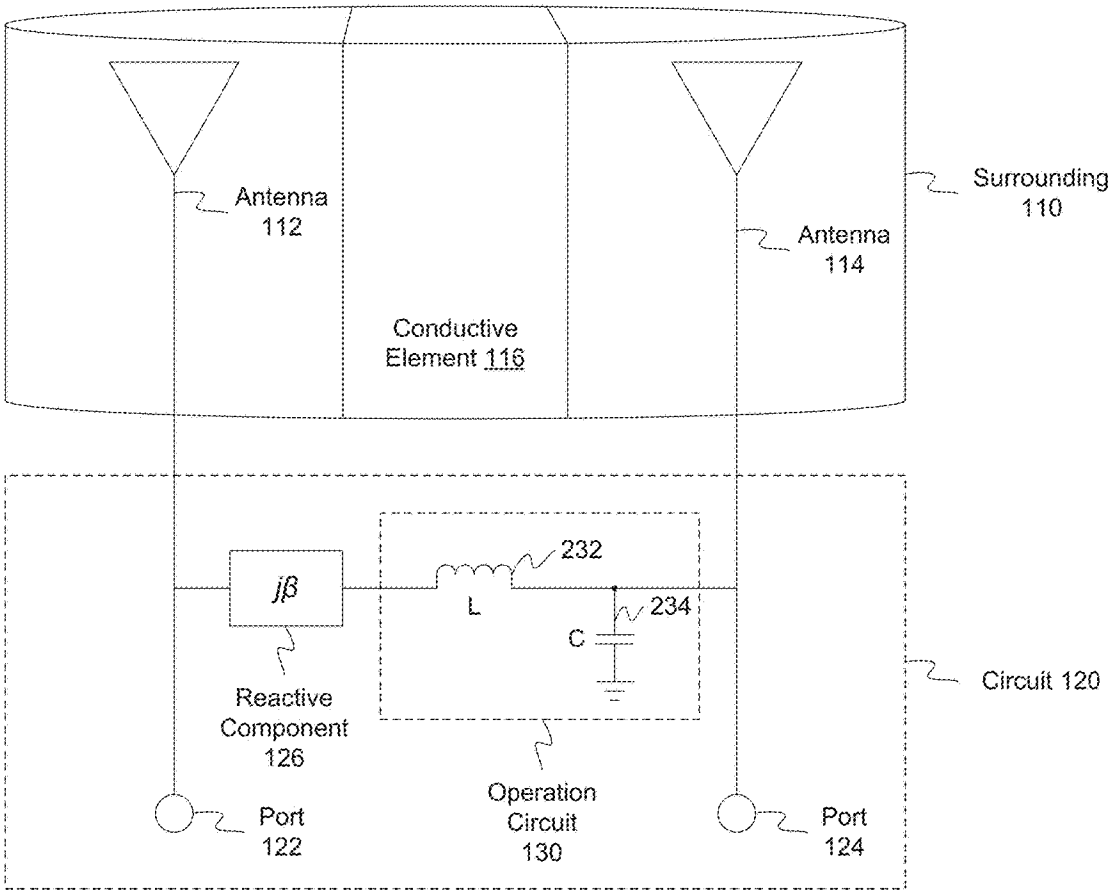
FIG. 2 is a diagram illustrating a circuit for improving antenna isolation in a user device with a multi-band antenna system, according to another embodiment.

FIG. 2 is a diagram illustrating a circuit for improving antenna isolation in a user device with a multi-band antenna system, according to another embodiment. In one embodiment, when reactive component 126 is designed to effectively increase antenna isolation at a low frequency (e.g., 2.4 GHz), operation circuit 130 may be a low-pass filter. The low-pass filter can be designed to enable signal flow through reactive component 126 at frequency bands below the cutoff frequency of the filter design. Thus, if antennas 112 and 114 are designed to operate at either 2.4 GHz or 5 GHz, the low-pass filter may be designed to enable signal flow at frequencies below 3 GHz, for example. Therefore, the low-pass filter of operation circuit 130 may enable signal flow through reactive component 126 when antennas 112 and 114 are operating at 2.4 GHz, and disable signal flow through reactive component 126 when antennas 112 and 114 are operating at 5 GHz.

In one embodiment, the low-pass filter of operation circuit 130 may include at least an inductor 232 and a capacitor 234. At low frequencies, inductor 232 has low impedance and effectively functions as a short circuit and capacitor 234 has high impedance and effectively functions as an open circuit. At high frequencies, inductor 232 has high impedance and effectively functions as an open circuit and capacitor 234 has low impedance and effectively functions as a short circuit. Thus, at 2.4 GHz, signals may pass directly through inductor 232 enabling signal flow between antennas 112 and 114 through reactive component 126. At 5 GHz, signals may be blocked by inductor 232 preventing signal flow through reactive component 126. In other embodiments, the low-pass filter may have a more complex design and may include additional or different components. However, the signal attenuation capabilities of the low-pass filter should remain the same.

Figure 3:
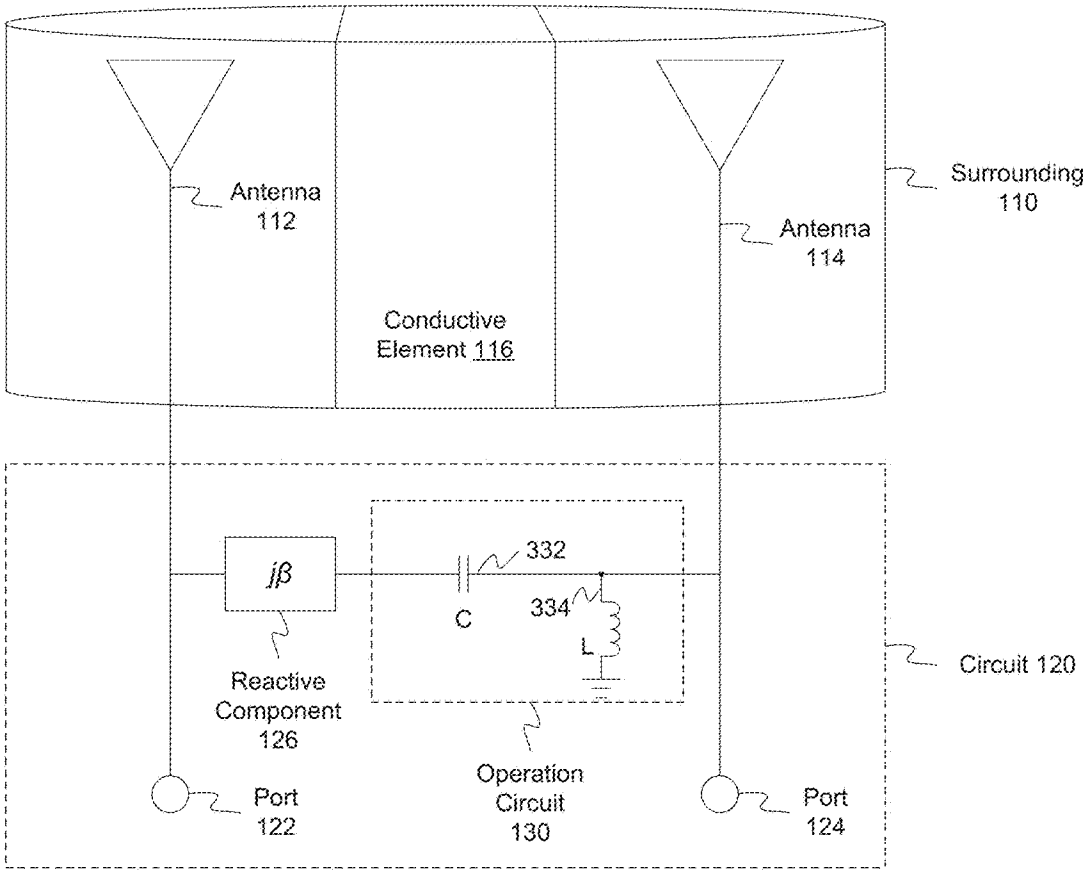
FIG. 3 is a diagram illustrating a circuit for improving antenna isolation in a user device with a multi-band antenna system, according to another embodiment.

FIG. 3 is a diagram illustrating a circuit for improving antenna isolation in a user device with a multi-band antenna system, according to another embodiment. In one embodiment, when reactive component 126 is designed to effectively increase antenna isolation at a high frequency (e.g., 5 GHz), operation circuit 130 may be a high-pass filter. The high-pass filter can be designed to enable signal flow through reactive component 126 at frequency bands above the cutoff frequency of the filter design. Thus, if antennas 112 and 114 are designed to operate at either 2.4 GHz or 5 GHz, the high-pass filter may be designed to enable signal flow at frequencies above 4 GHz, for example. Therefore, the high-pass filter of operation circuit 130 may enable signal flow through reactive component 126 when antennas 112 and 114 are operating at 5 GHz, and disable signal flow through reactive component 126 when antennas 112 and 114 are operating at 2.4 GHz.

In one embodiment, the high-pass filter of operation circuit 130 may include at least a capacitor 332 and an inductor 334. At low frequencies, capacitor 332 has high impedance and effectively functions as an open circuit and inductor 334 has low impedance and effectively functions as a short circuit. At high frequencies, capacitor 332 has low impedance and effectively functions as a short circuit and inductor 334 has high impedance and effectively functions as an open circuit. Thus, at 5 GHz, signals may pass directly through capacitor 332 enabling signal flow between antennas 112 and 114 through reactive component 126. At 2.4 GHz, signals may be blocked by capacitor 332 preventing signal flow through reactive component 126. In other embodiments, the high-pass filter may have a more complex design and may include additional or different components. However, the signal attenuation capabilities of the high-pass filter should remain the same.

Figure 4A:
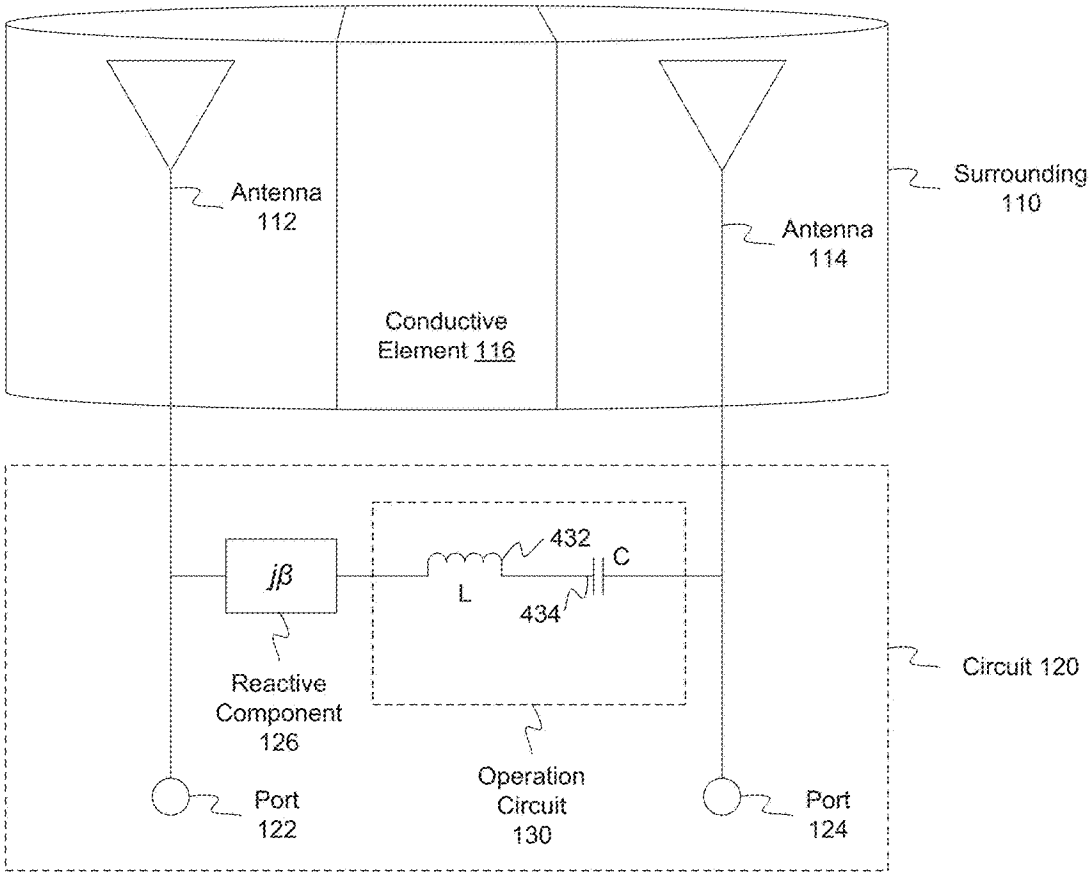
FIG. 4*a* is a diagram illustrating a circuit for improving antenna isolation in a user device with a multi-band antenna system, according to another embodiment.

FIG. 4*a* is a diagram illustrating a circuit for improving antenna isolation in a user device with a multi-band antenna system, according to another embodiment. In one embodiment, when reactive component 126 is designed to effectively increase antenna isolation at either a low frequency (e.g., 2.4 GHz) or a high frequency (e.g., 5 GHz), operation circuit 130 may be a band-pass filter. The band-pass filter can be designed to enable signal flow through reactive component 126 at frequency bands between the high and low cutoff frequencies of the filter design. Thus, if reactive component 126 is designed for 2.4 GHz, the band-pass filter may be designed to enable signal flow at frequencies between 1.4 GHz and 3.4 GHz, for example. If reactive component 126 is designed for 5 GHz, the band-pass filter may be designed to enable signal flow at frequencies between 4 GHz and 6 GHz, for example. Therefore, the band-pass filter of operation circuit 130 may enable signal flow through reactive component 126 when antennas 112 and 114 are operating at one frequency, and disable signal flow through reactive component 126 when antennas 112 and 114 are operating at other frequencies.

In one embodiment, the band-pass filter of operation circuit 130 may include at least an inductor 432 and a capacitor 434. At low frequencies, inductor 432 has low impedance and effectively functions as a short circuit and capacitor 434 has high impedance and effectively functions as an open circuit. At high frequencies, inductor 432 has high impedance and effectively functions as an open circuit and capacitor 434 has low impedance and effectively functions as a short circuit. Thus, the values of inductor 432 and capacitor 434 may be designed to enable signal flow between antennas 112 and 114 through reactive component 126 at the desired frequency. In other embodiments, the band-pass filter may have a more complex design and may include additional or different components. However, the signal attenuation capabilities of the band-pass filter should remain the same.

Figure 4B:
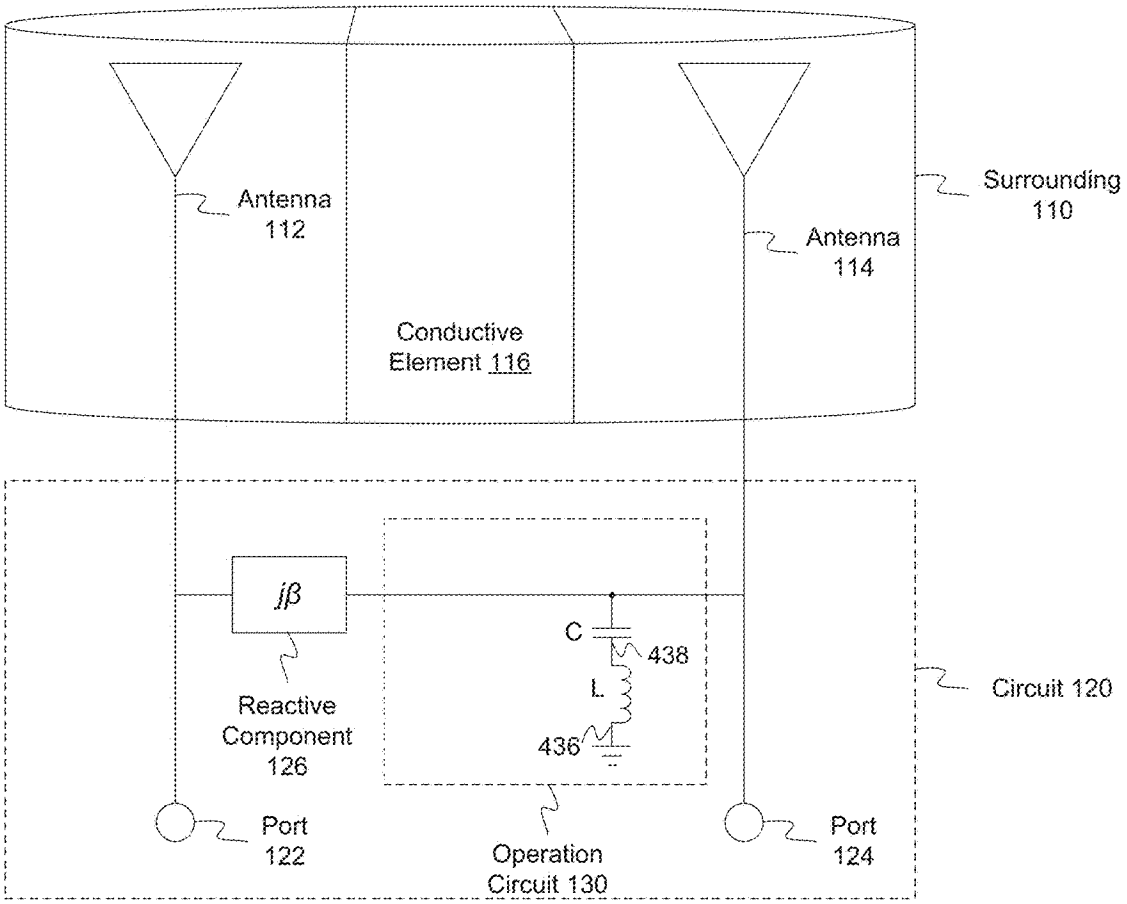
FIG. 4*b* is a diagram illustrating a circuit for improving antenna isolation in a user device with a multi-band antenna system, according to another embodiment.

FIG. 4*b* is a diagram illustrating a circuit for improving antenna isolation in a user device with a multi-band antenna system, according to another embodiment. In one embodiment, when reactive component 126 is designed to effectively increase antenna isolation at either a low frequency (e.g., 2.4 GHz) or a high frequency (e.g., 5 GHz), operation circuit 130 may be a band-stop filter. The band-stop filter can be designed to disable signal flow through reactive component 126 at frequency bands between the high and low cutoff frequencies of the filter design. Thus, if reactive component 126 is designed for 2.4 GHz, but the antenna system is also designed to operate at 5 GHz, the band-stop filter may be designed to disable signal flow at frequencies between 4 GHz and 6 GHz, for example. If reactive component 126 is designed for 5 GHz, the band-stop filter may be designed to disable signal flow at frequencies between 1.4 GHz and 3.4 GHz, for example. Therefore, the band-stop filter of operation circuit 130 may disable signal flow through reactive component 126 when antennas 112 and 114 are operating one frequency, and enable signal flow through reactive component 126 when antennas 112 and 114 are operating at other frequencies.

In one embodiment, the band-stop filter of operation circuit 130 may include at least an inductor 436 and a capacitor 438. At low frequencies, inductor 436 has low impedance and effectively functions as a short circuit and capacitor 438 has high impedance and effectively functions as an open circuit. At high frequencies, inductor 436 has high impedance and effectively functions as an open circuit and capacitor 438 has low impedance and effectively functions as a short circuit. Thus, the values of inductor 436 and capacitor 438 may be designed to disable signal flow between antennas 112 and 114 through reactive component 126 at the desired frequency. In other embodiments, the band-stop filter may have a more complex design and may include additional or different components. However, the signal attenuation capabilities of the band-stop filter should remain the same.

Figure 5:
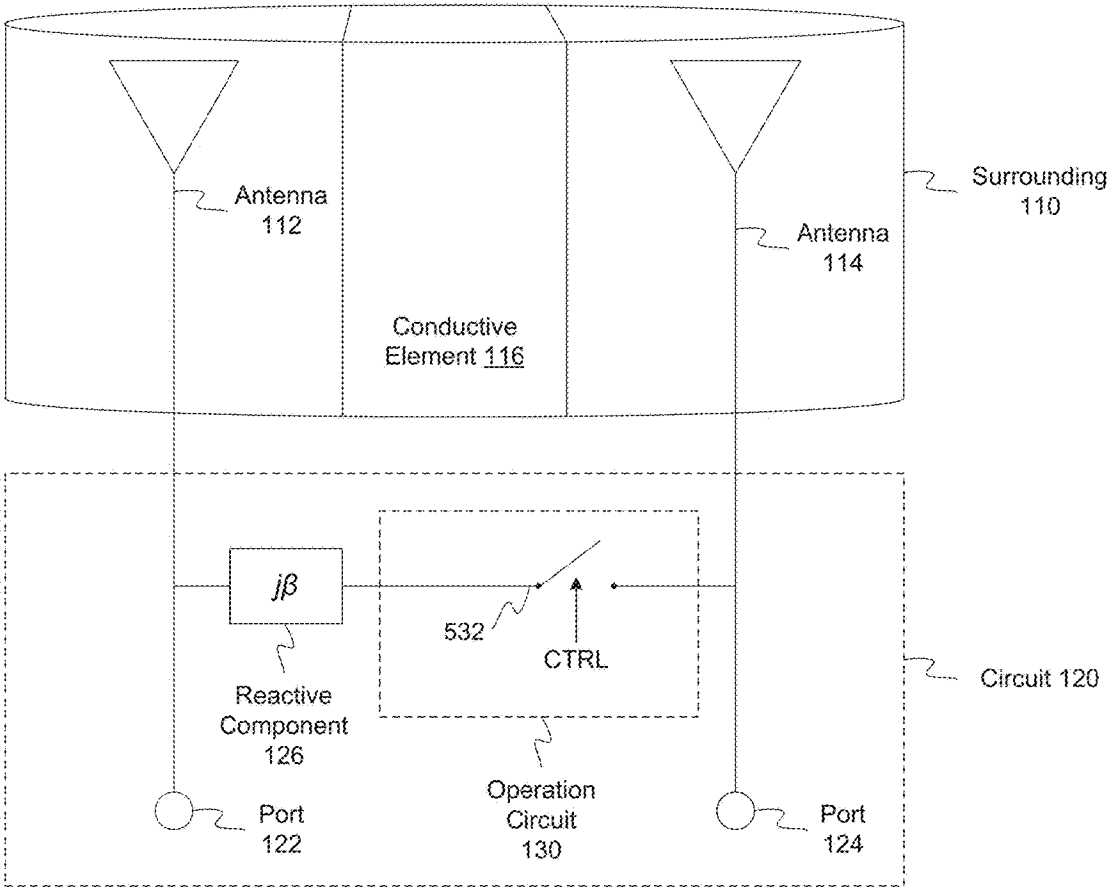
FIG. 5 is a diagram illustrating a circuit for improving antenna isolation in a user device with a multi-band antenna system, according to another embodiment.

FIG. 5 is a diagram illustrating a circuit for improving antenna isolation in a user device with a multi-band antenna system, according to another embodiment. In one embodiment, when reactive component 126 is designed to effectively increase antenna isolation at either a low frequency (e.g., 2.4 GHz) or a high frequency (e.g., 5 GHz), operation circuit 130 may include a switch 532. The switch 532 can be designed to enable signal flow through reactive component 126 when switch 532 is closed or activated. Switch 532 may be implemented using transistors, logic gates, relays, or any other components that connect or disconnect signals and communication paths between electrical devices. In one embodiment, switch 532 is operated by a control signal CTRL. The control signal CTRL may be received from a processing device or other system component and the value of control signal CTRL may reflect the frequency at which antennas 112 and 114 are operating. Thus, if reactive component 126 is designed for 2.4 GHz, control signal CTRL may close switch 532 to enable signal flow at frequencies when antennas 112 and 114 are operating at 2.4 GHz. Control signal CTRL may then open switch 532 to prevent signal flow through reactive component 126, when antennas 112 and 114 are operating at 5 GHz. If reactive component 126 is designed for 5 GHz, control signal CTRL may close switch 532 to enable signal flow at frequencies when antennas 112 and 114 are operating at 5 GHz and open switch 532 to prevent signal flow through reactive component 126, when antennas 112 and 114 are operating at 2.4 GHz.

Figure 6:
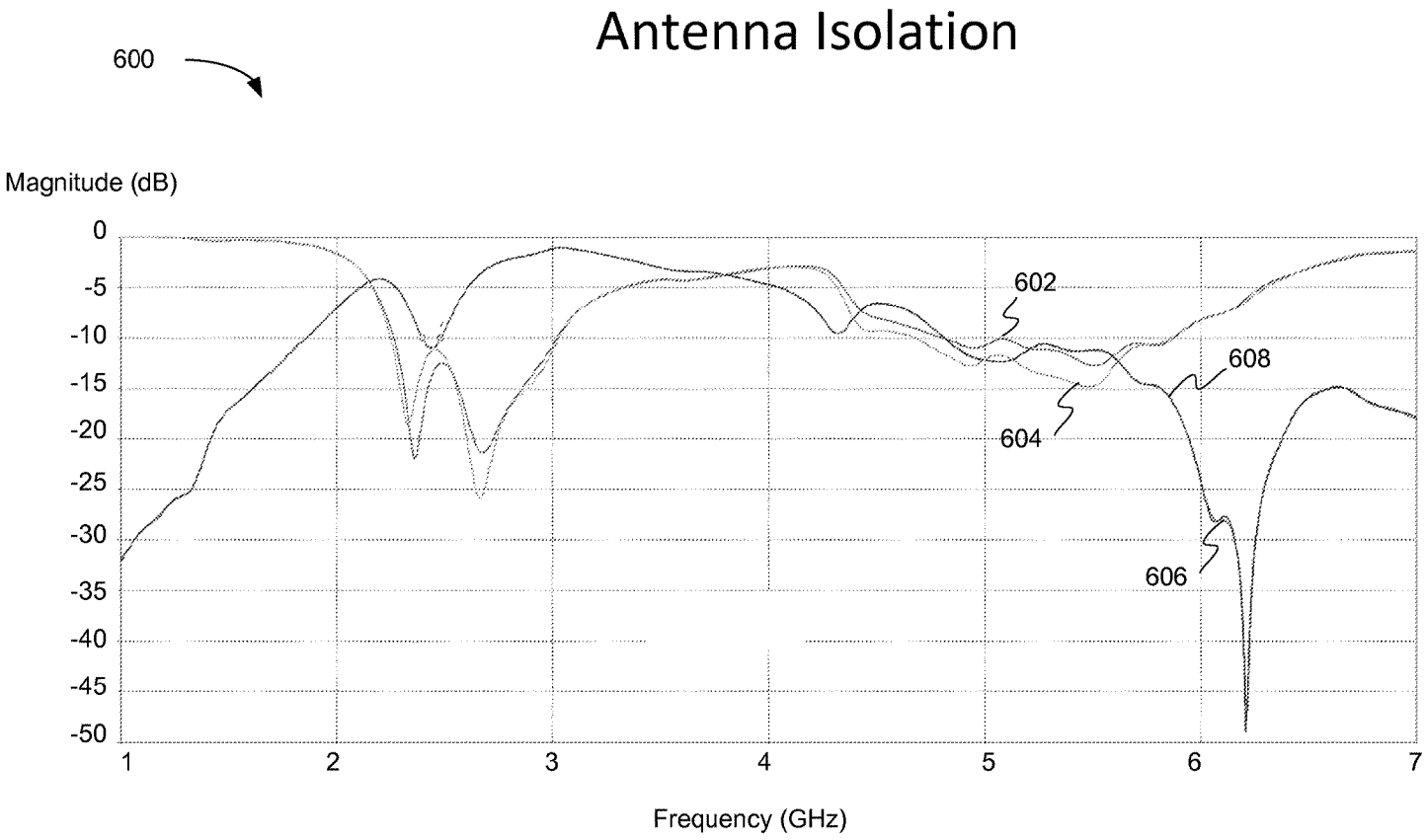
FIG. 6 is a graph diagram illustrating improved antenna isolation in a user device with a multi-band antenna system, according to an embodiment.

FIG. 6 is a graph diagram illustrating improved antenna isolation in a user device with a multi-band antenna system, according to an embodiment. In one embodiment, graph 600 plots frequency values against scattering parameters (S-parameters) measured in decibels (dB). The S11 602 and S22 604 parameters represent the return loss of two antenna ports (e.g., ports 122, 124). In one embodiment, the return loss is a ratio between reflection power and the incident power. For example, the design criteria for the system may be to have the return loss be below approximately 10 dB. The S12 606 and S21 608 parameters represent the coupling between the two antennas. The design criteria for the system may be to also have the coupling be below approximately 10 dB. In one embodiment, S11 602 has a tendency to conflict with S21 608 and S22 604 has a tendency to conflict with S12 606. When S11 602 and S22 604 are deep, S21 608 and S12 606 are generally shallower, and vice versa. This trade-off means that if S11 602 and S22 604 are deep, the power into the ports 122, 124 is encountered with less reflection. This may mean that more power is transmitted over the air. Thus there is a chance that more transmitted power would reach to other port, thereby increasing S21 608 and S12 606. Graph 600 shows that with the designed dual-band isolation circuit, the return loss and isolation are below 10 dB at each of the two operating bands (i.e., 2.4-2.48 GHz and 5.2-5.8 GHz.

Figure 7:
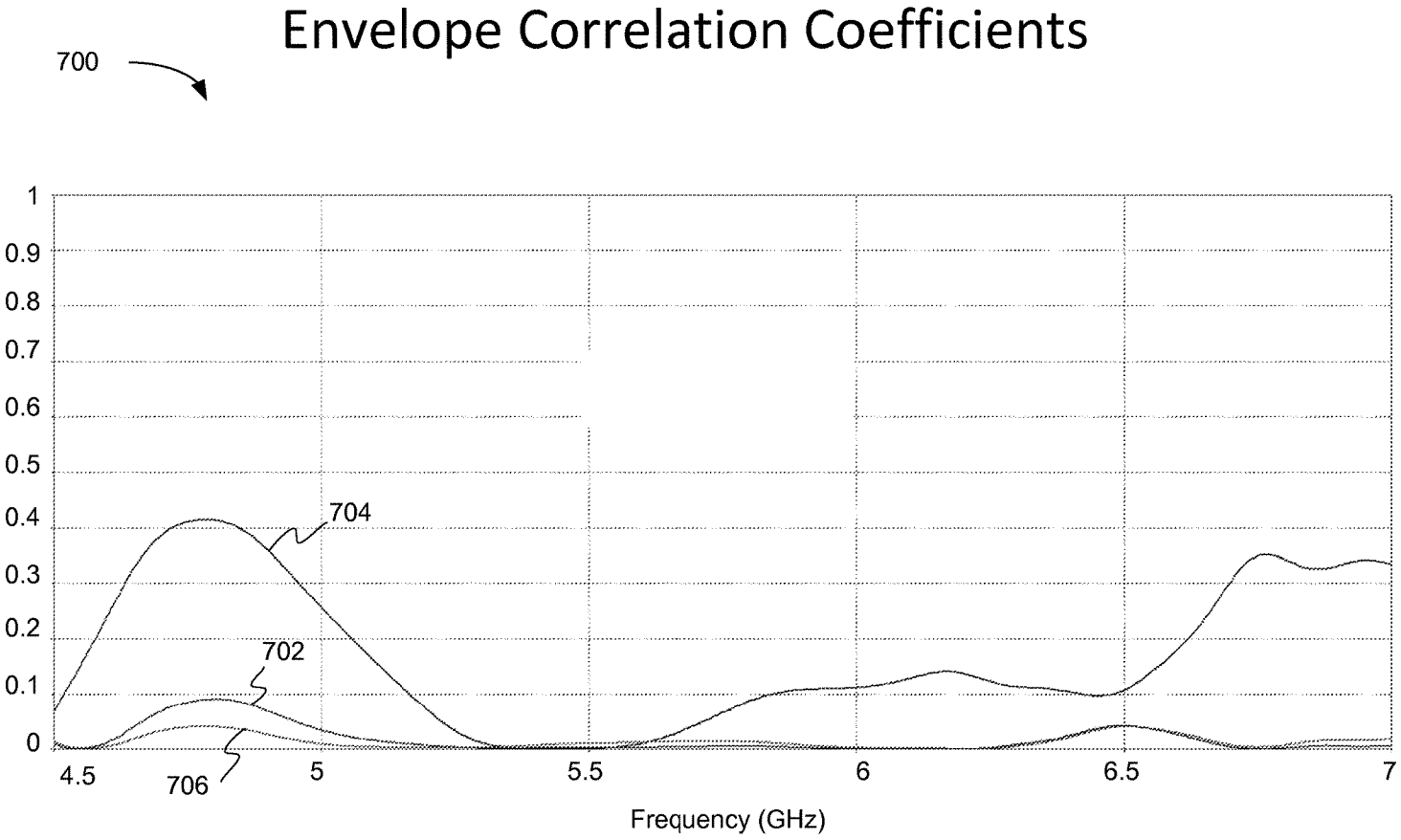
FIG. 7 is a graph diagram illustrating improved envelope correlation coefficients at high frequencies in a user device with a multi-band antenna system, according to an embodiment.

FIG. 7 is a graph diagram illustrating improved envelope correlation coefficients at high frequencies in a user device with a multi-band antenna system, according to an embodiment. In one embodiment, graph 700 plots frequency values against E.C.C. for each of a default system 702 with no additional isolation, a single-band isolation network 704, and a dual-band isolation network 706, as illustrated in FIGS. 1-5. Graph 700 illustrates improved E.C.C. values with the dual-band isolation network 706 (e.g., using reactive component 126 and operation circuit 130) when antennas 112 and 114 are operating at 5 GHz and when reactive component 126 is designed to improve isolation at 2.4 GHz, or some other lower frequency. At a frequency of 5 GHz, the E.C.C. value for the default system 702 is less than 0.1 (i.e., approximately 0.04). The E.C.C. value for the single band isolation network 704, which uses reactive component 126 to improve isolation at 2.4 GHz, but does not include operation circuit 130, increases to approximately 0.25 at 5 GHz. By using operation circuit 130 to disable signal flow through reactive component 126 at 5 GHz, the E.C.C. value for the dual-band isolation network 706 decreases to almost zero (i.e., approximately 0.01). The E.C.C. value represents the correlation of radiation patterns of antennas 112 and 114. In one embodiment, the E.C.C. value is computed by taking a cross product of two far field patterns over a sphere. E.C.C. is often used as a benchmark in MIMO systems. A lower E.C.C. value indicates a higher capacity and greater reliability in the MIMO system.

Figure 8:
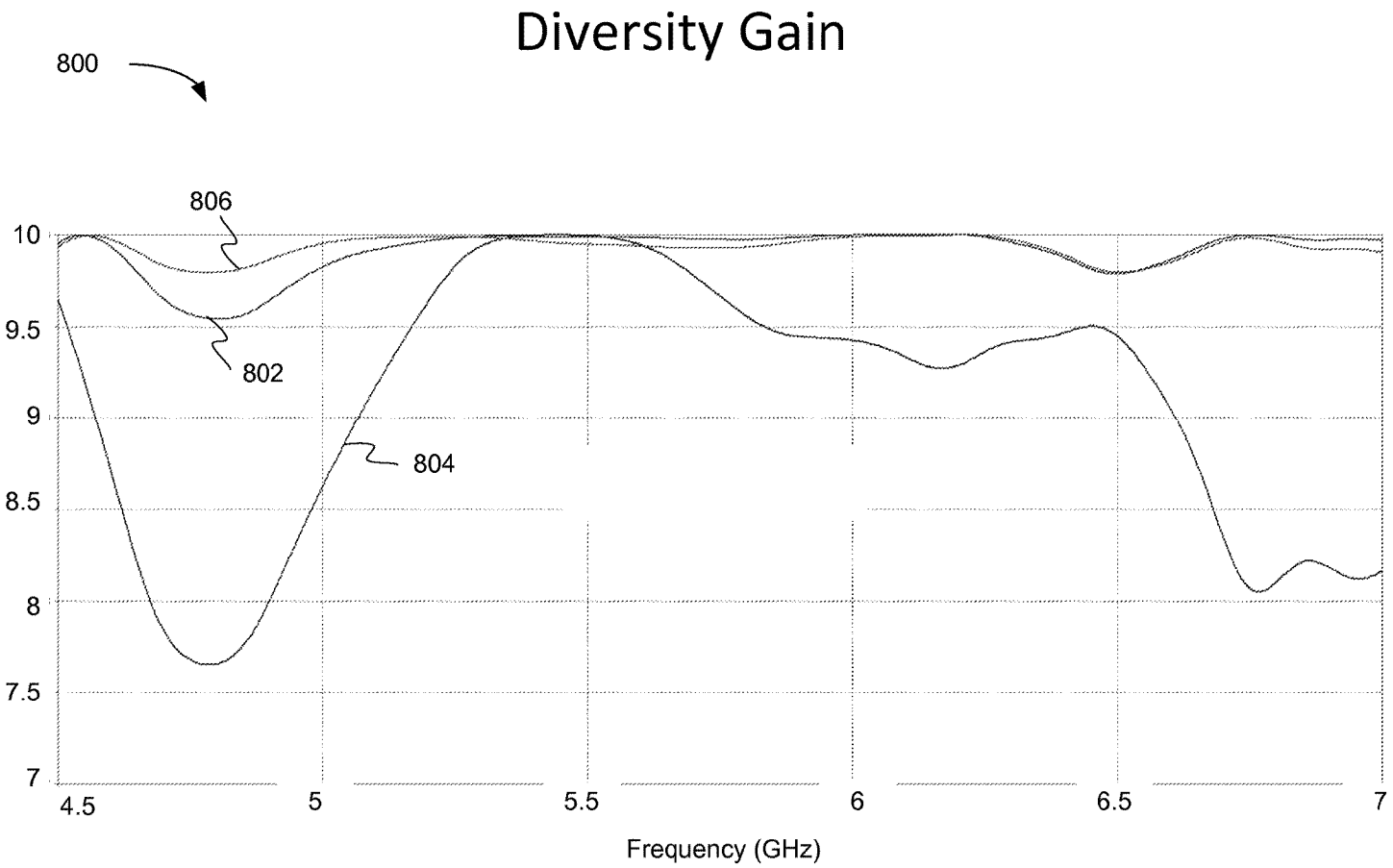
FIG. 8 is a graph diagram illustrating improved diversity gain at high frequencies in a user device with a multi-band antenna system, according to an embodiment.

FIG. 8 is a graph diagram illustrating improved diversity gain at high frequencies in a user device with a multi-band antenna system, according to an embodiment. In one embodiment, graph 800 plots frequency values against diversity gain for each of a default system 802 with no additional isolation, a single-band isolation network 804, and a dual-band isolation network 806, as illustrated in FIGS. 1-5. Graph 800 illustrates improved diversity gain values with the dual-band isolation network 806 (e.g., using reactive component 126 and operation circuit 130) when antennas 112 and 114 are operating at 5 GHz and when reactive component 126 is designed to improve isolation at 2.4 GHz, or some other lower frequency. At a frequency of 5 GHz, the diversity gain value for the default system 802 is approximately 9.6. The diversity gain value for the single band isolation network 804, which uses reactive component 126 to improve isolation at 2.4 GHz, but does not include operation circuit 130, decreases to approximately 8.52 at 5 GHz. By using operation circuit 130 to disable signal flow through reactive component 126 at 5 GHz, the diversity gain value for the dual-band isolation network 806 increases to almost 10 (i.e., approximately 9.9). In one embodiment, the diversity gain value represents an increase in signal-to-interference ratio due to some diversity scheme, or how much the transmission power can be reduced when a diversity scheme is introduced, without suffering a performance loss. In this context, a diversity scheme refers to two antenna signals in a MIMO system. Diversity is used in combatting signal fading and co-channel interference while avoiding error bursts.

Figure 9:
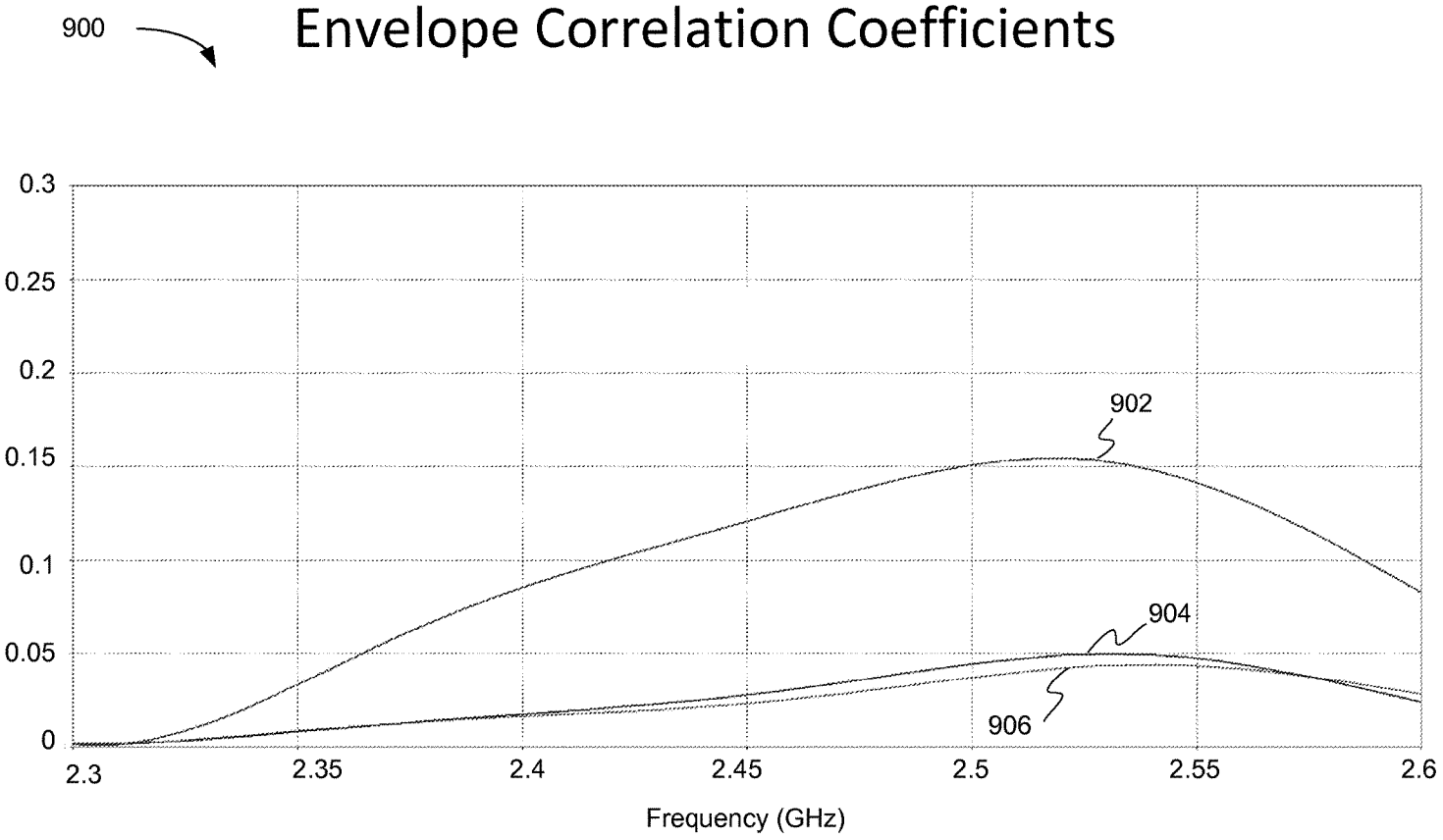
FIG. 9 is a graph illustrating envelope correlation coefficients at low frequencies in a user device with a multi-band antenna system, according to an embodiment.

FIG. 9 is a graph illustrating envelope correlation coefficients at low frequencies in a user device with a multi-band antenna system, according to an embodiment. In one embodiment, graph 900 plots frequency values against E.C.C. for each of a default system 902 with no additional isolation, a single-band isolation network 904, and a dual-band isolation network 906, as illustrated in FIGS. 1-5. Graph 900 illustrates improved E.C.C. values with the dual-band isolation network 906 (e.g., using reactive component 126 and operation circuit 130) when antennas 112 and 114 are operating at 2.4 GHz and when reactive component 126 is designed to improve isolation at 2.4 GHz. At a frequency of 2.4 GHz, the E.C.C. value for the default system 902 is almost 0.1 (i.e., approximately 0.08). The E.C.C. value for the single band isolation network 904, which uses reactive component 126 to improve isolation at 2.4 GHz, decreases to approximately 0.02 at 5 GHz. By using operation circuit 130 to disable signal flow through reactive component 126 at 2.4 GHz, the dual-band isolation network 906 maintains a similar E.C.C. value to single band isolation network 904 of approximately 0.02.

Figure 10:
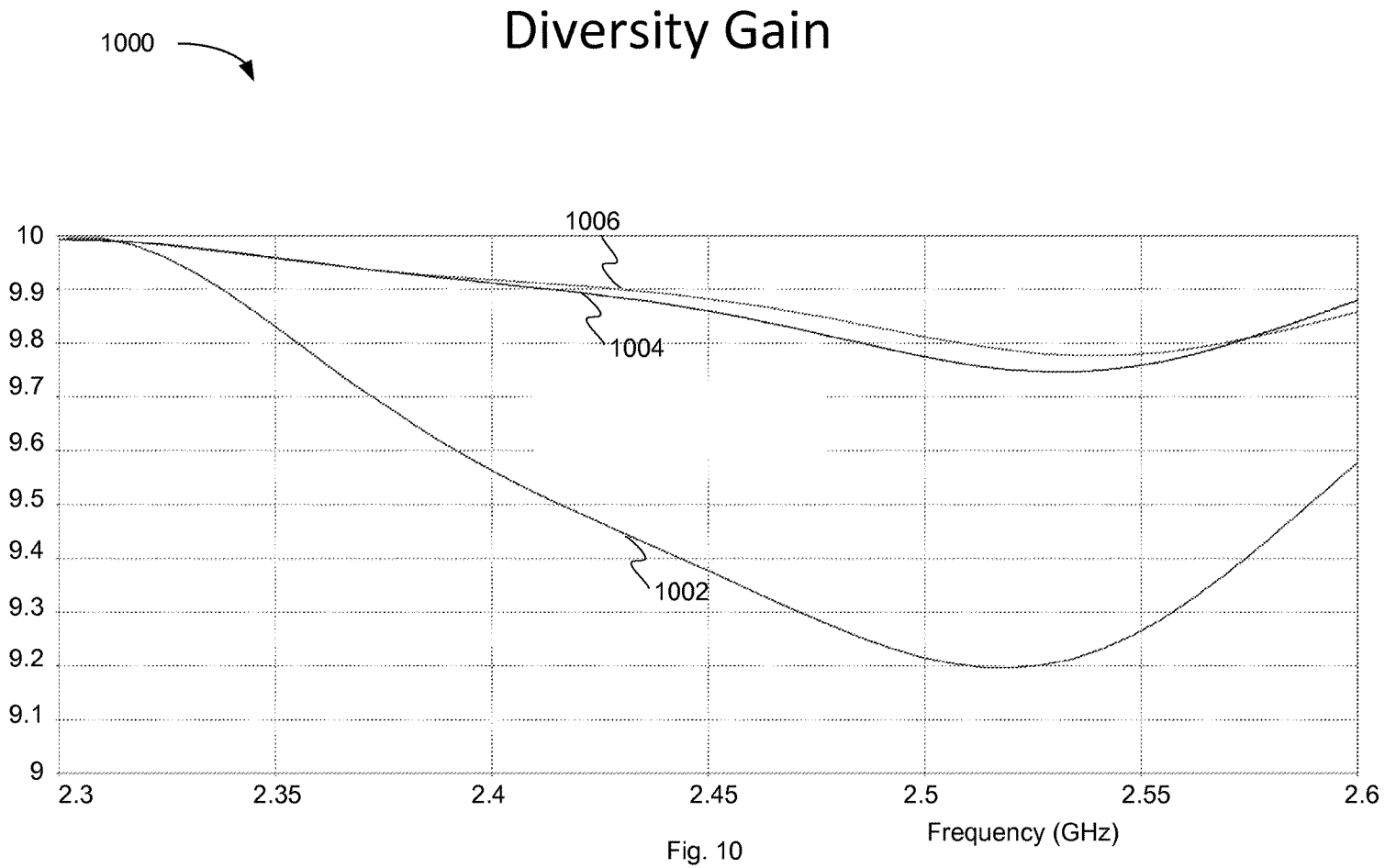
FIG. 10 is a graph illustrating diversity gain at low frequencies in a user device with a multi-band antenna system, according to an embodiment.

FIG. 10 is a graph illustrating diversity gain at low frequencies in a user device with a multi-band antenna system, according to an embodiment. In one embodiment, graph 1000 plots frequency values against diversity gain for each of a default system 1002 with no additional isolation, a single-band isolation network 1004, and a dual-band isolation network 1006, as illustrated in FIGS. 1-5. Graph 1000 illustrates improved diversity gain values with the dual-band isolation network 1006 (e.g., using reactive component 126 and operation circuit 130) when antennas 112 and 114 are operating at 2.4 GHz and when reactive component 126 is designed to improve isolation at 2.4 GHz. At a frequency of 2.4 GHz, the diversity gain value for the default system 1002 is approximately 9.65. The diversity gain value for the single band isolation network 1004, which uses reactive component 126 to improve isolation at 2.4 GHz, but does not include operation circuit 130, increases to approximately 9.91 at 2.4 GHz. By using operation circuit 130 to disable signal flow through reactive component 126 at 2.4 GHz, the dual-band isolation network 1006 maintains a similar diversity gain value to single band isolation network 1004 of approximately 9.91.

Figure 11:
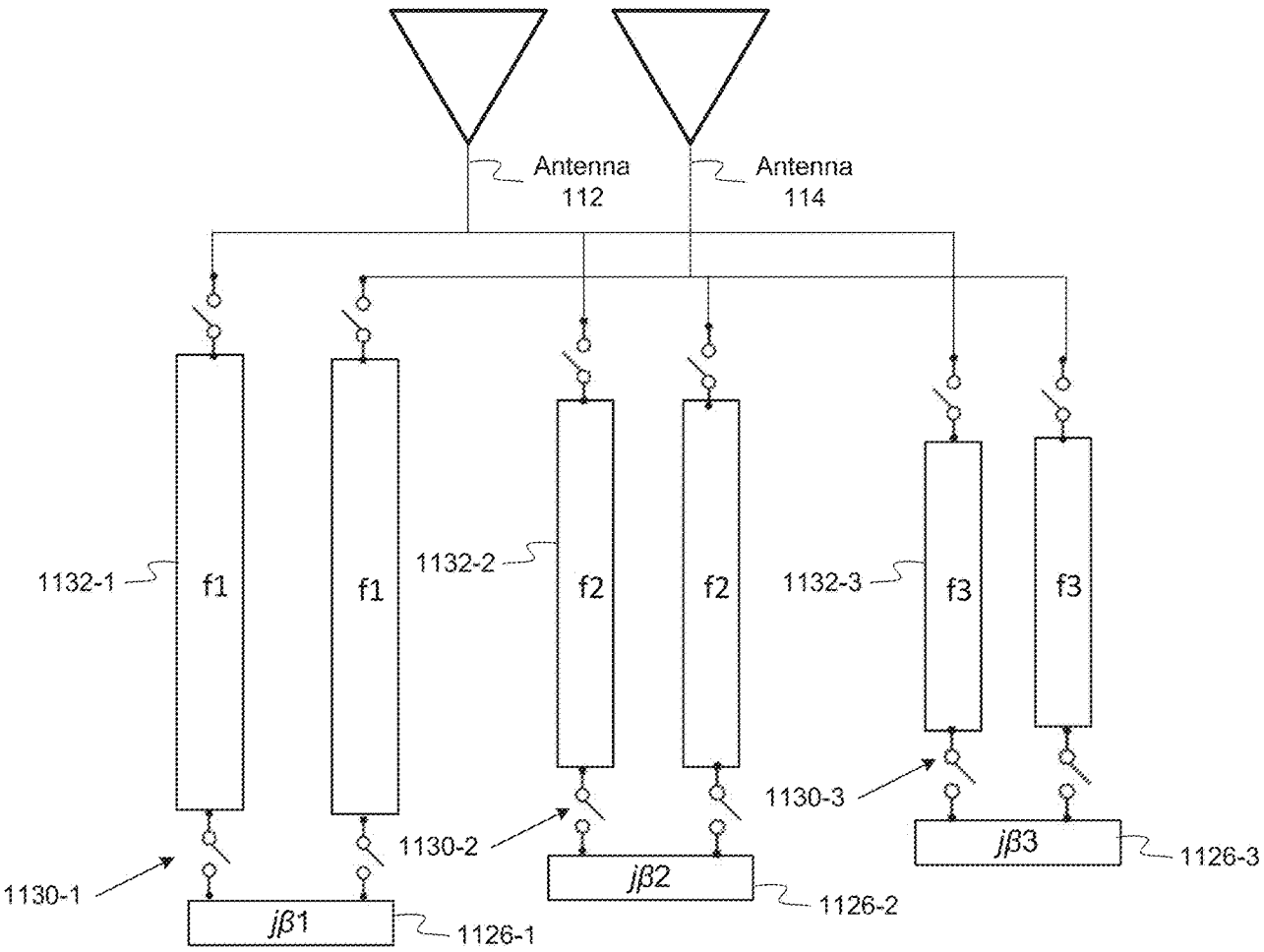
FIG. 11 is a diagram illustrating a circuit for improving antenna isolation in a user device with a multi-band antenna system, according to another embodiment.

FIG. 11 is a diagram illustrating a circuit for improving antenna isolation in a user device with a multi-band antenna system, according to another embodiment. In one embodiment, the antenna system include multiple reactive components 1126-1, 1126-2, 1126-3, where each reactive component is designed to reduce signal coupling at a different frequency f1, f2, f3. Each reactive component 1126-1, 1126-2, 1126-3 may have a corresponding operation circuit 1130-1, 1130-2, 1130-3 designed to enable the corresponding reactive component only when the antennas 112 and 114 are operating at the frequency for which the corresponding reactive component was designed. In the illustrated embodiment, the operation circuits 1130-1, 1130-2, 1130-3 are switches that can be activated or deactivate according to frequency at which the antennas 112 and 114 are currently operating. For example, if the antennas 112 and 114 are operating at a first frequency f1 (e.g., 2.4 GHz), the switches in operation circuit 1130-1 may be activated and the switches in operation circuits 1130-2 and 1130-3 may be deactivated.

In one embodiment, each reactive component 1126-1, 1126-2, 1126-3 has a corresponding set of transmission lines 1132-1, 1132-2, 1132-3. One transmission line of each set may connect the reactive component to antenna 112, while the other line of the set may connect the reactive component to antenna 114. The set of transmission lines for each reactive component may have a length that is designed to improve isolation at a given frequency in conjunction with the associated reactive component. In this manner, antenna isolation and E.C.C. can be improved at each of the various different frequencies f1, f2, f3 for which the multi-band antenna system is designed to operate.

Figure 12:
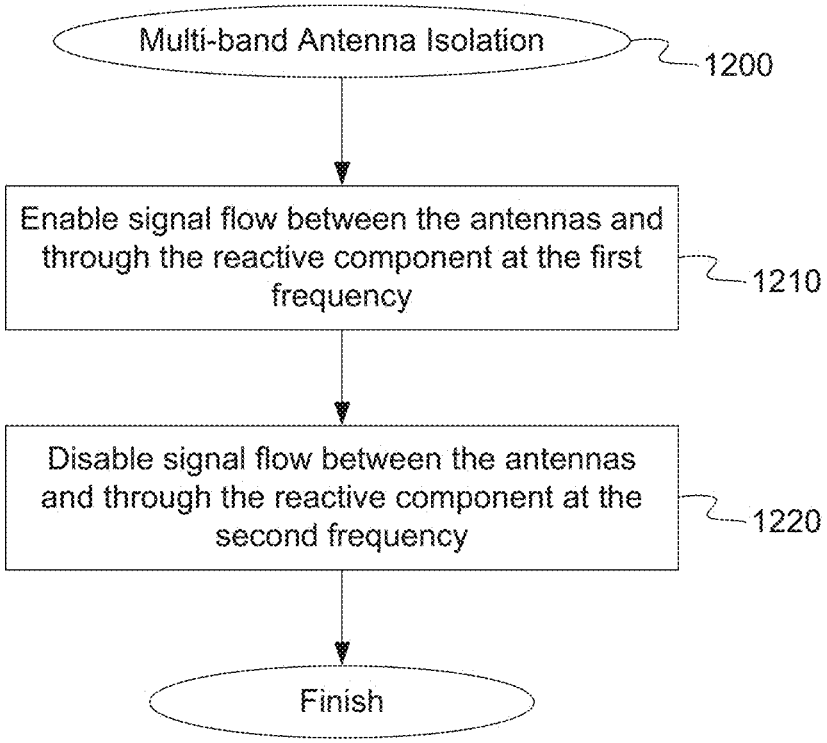
FIG. 12 is a flow diagram illustrating a method for improving antenna isolation in a user device with a multi-band antenna system, according to embodiment.

FIG. 12 is a flow diagram illustrating a method for improving antenna isolation in a user device with a multi-band antenna system, according to embodiment. At block 1210, method 1200 enables, using an operation circuit 130 coupled to reactive component 126 between first antenna 112 and second antenna 114, signal flow between the first antenna 112 and the second antenna 114 along signal path 128 formed by reactive component 126 and operation circuit 130 when first antenna 112 and second antenna 114 are operating at the first frequency. At block 1220, method 1200 disables, using the operation circuit 130, signal flow between the first antenna 112 and the second antenna 114 along signal path 128 when first antenna 112 and second antenna 114 are operating at a second frequency different from the first frequency. In one embodiment, a signal coupling between first antenna 112 and second antenna 114 occurs via over-the-air signal path 112 when the antennas are operating at the first frequency, and a first signal along over-the-air signal path 118 has a first phase. In one embodiment, a second signal along signal path 128 formed by reactive component 126 and operation circuit 130 has a second phase that is 180 degrees offset from the first phase (i.e., opposite the first phase) and the two signals cancel each other out to negate the signal coupling.

Figure 13:
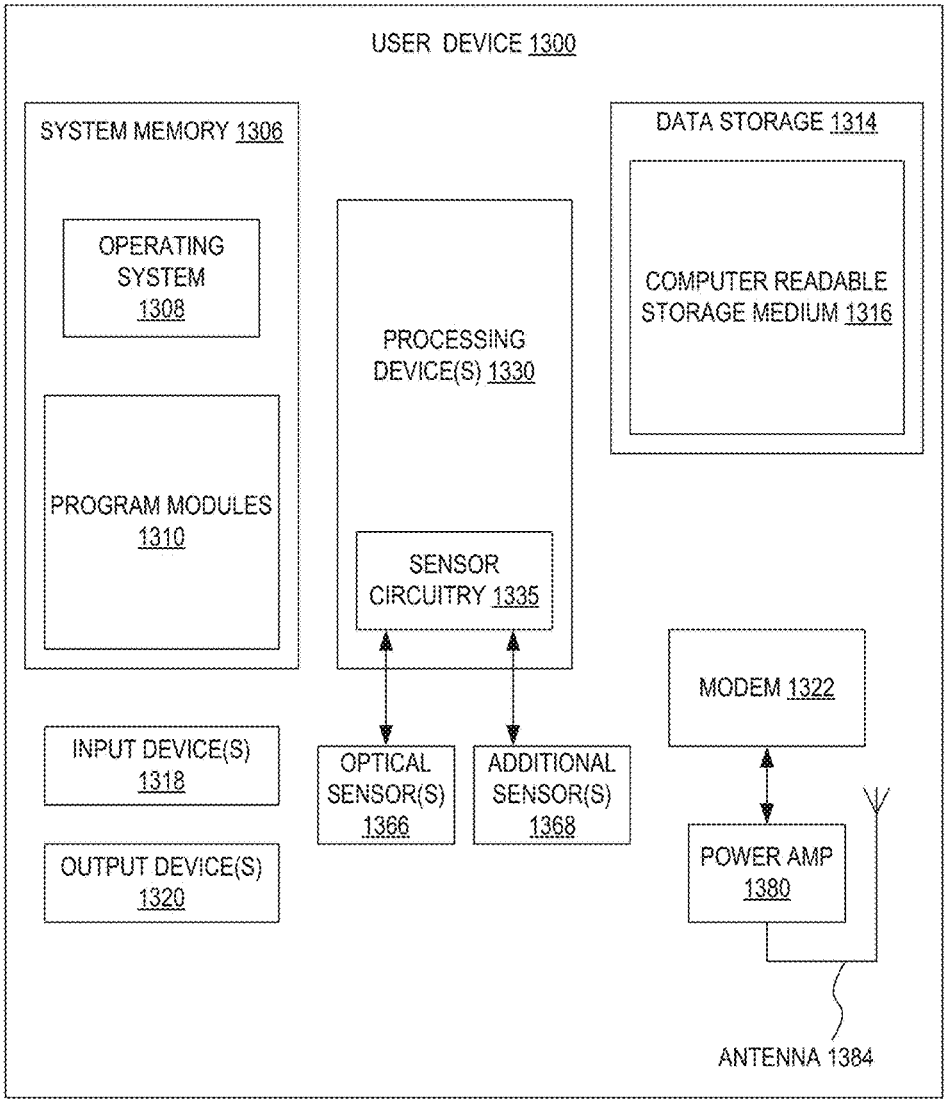
FIG. 13 is a block diagram illustrating an exemplary user device, according to an embodiment.

FIG. 13 is a block diagram illustrating an exemplary user device 1300, according to an embodiment. In one embodiment, the user device 1300 may correspond to user device 100 of FIG. 1 and may be any type of user device such as an electronic book reader, a PDA, a mobile phone, a laptop computer, a portable media player, a tablet computer, an electronic pad, a desktop computer, a camera, a video camera, a netbook, and the like.

The user device 1300 includes one or more processing devices 1330, such as one or more CPUs, microcontrollers, field programmable gate arrays, or other types of processors. The user device 1300 also includes system memory 1306, which may correspond to any combination of volatile and/or non-volatile storage mechanisms. The system memory 1306 stores information which provides an operating system component 1308, various program modules 1310, and/or other components. The user device 1300 performs functions by using the processing device(s) 1330 to execute instructions provided by the system memory 1306.

The user device 1300 also includes a data storage device 1314 that may be composed of one or more types of removable storage and/or one or more types of non-removable storage. The data storage device 1314 includes a computer-readable storage medium 1316 on which is stored one or more sets of instructions embodying any one or more of the methodologies or functions described herein. As shown, the instructions may reside, completely or at least partially, within the computer readable storage medium 1316, system memory 1306 and/or within the processing device(s) 1330 during execution thereof by the user device 1300, the system memory 1306 and the processing device(s) 1330 also constituting computer-readable media. The user device 1300 may also include one or more input devices 1318 (keyboard, mouse device, specialized selection keys, etc.) and one or more output devices 1320 (displays, printers, audio output mechanisms, etc.).

The user device 1300 further includes a wireless modem 1322 to allow the user device 1300 to communicate via a wireless network (e.g., such as provided by the wireless communication system) and/or with other computing devices, such as remote computers, the item providing system, online book stores, electronic catalogs for libraries, and so forth. The wireless modem 1322 may allow the user device 1300 to handle both voice and non-voice communications (such as communications for text messages, multimedia messages, media downloads, web browsing, etc.) with the wireless communication system. The wireless modem 1322 may provide network connectivity using any type of mobile network technology including, for example, cellular digital packet data (CDPD), general packet radio service (GPRS), enhanced data rates for GSM evolution (EDGE), universal mobile telecommunications system (UMTS), 1 times radio transmission technology (1×RTT), evaluation data optimized (EVDO), high-speed downlink packet access (HSDPA), WiFi, etc. The wireless modem 1322 may generate signals and send these signals to power amplifier (amp) 1380 for amplification, after which they are wirelessly transmitted via antenna 1384. In addition to sending data, antenna 1384 also receives data, which is sent to wireless modem 1322 and transferred to processing device(s) 1330.

In one embodiment, user device 1300 includes an optical sensor 1366. The optical sensor 1366 may be a low resolution camera (e.g., having 0.2 or 0.3 Megapixels) that takes images (e.g., of a user's eyes) on a periodic basis. Alternatively, the optical sensor 1366 may have a higher resolution, such as 1 Megapixel up to 10 or more Megapixels. The optical sensor 1366 may be positioned such that images are taken of a user's face while the user holds the user device 1300 in front of his face in a standard reading position. Therefore, the optical sensor 1366 may be used to track user eye movement during reading.

In one embodiment, user device 1300 includes one or more additional sensors 1368 such as a physical contact sensor, close proximity sensors, or motion sensors. The sensors 1368 can detect the presence of human body parts, and convey information regarding the detected presence to processing device(s) 1330. In one embodiment, the sensors 1368 may be capacitive sensors that are configured to measure capacitance generated by the presence of the human body part using any one of various techniques known in the art, for example, relaxation oscillation, a current verses voltage phase shift comparison, resistor-capacitor charge timing, capacitive bridge division, charge transfer, sigma-delta modulation, or charge-accumulation. In an alternative embodiment, the sensors 1368 may also be optical (e.g., infrared) sensors that use an emitter and receiver pair to detect the presence of opaque objects. Alternatively, the sensors 1368 may be inductive sensors, which include an inductive loop. When the presence of a human body part (or metal object) is brought close to the inductive sensor, an induction of the inductive loop changes, causing the human body part to be detected. Alternatively, the sensors 1368 may be ultrasonic sensors that emit an ultrasonic signal and measure a time duration between when a signal is transmitted and the reflection of that signal received (a.k.a., flight response). The sensors 1368 may also include other types of sensors, such as those that operate using the detection principles of resistive (e.g., analog resistive, digital resistive or residual resistive), surface acoustic wave, electromagnetic, near field imaging, or other technologies. In one embodiment, multiple different types of sensors are used. Though the detected object is described herein as a human body part, other types of objects may also be detected depending on the sensing technologies used.

In one embodiment, the additional sensors 1368 include a motion sensor, such as an accelerometer or one or more gyroscopes. The user device 1300 may use motion data from motion sensors to determine whether a user is holding the user device 1300. For example, if the user device 1300 experiences constant minor accelerations, it may be determined that the user device 1300 is being held in a user's hand. Additionally, if the user device 1300 is at a particular angle (detectable based on acceleration readings from an accelerometer), it may be determined that the user device 1300 is being rested on a user's leg during reading.

The processing device(s) 1330 may include sensor circuitry 1335 (e.g., sensor device drivers) that enables the processing device (s) 1330 to interpret signals received from the optical sensor(s) 1366 and/or additional sensors 1368. In one embodiment, the optical sensors 1366 and/or additional sensors 1368 output raw sensor data. In another embodiment, the optical sensors 1366 and/or additional sensors 1368 output fully processed signals to the processing device (s) 1330. For example, the additional sensors 1368 may output a user contact/no user contact signal using a single line interface or a multi-line interface. In another embodiment, the additional sensors 1368 output, for example, positional data and/or object presence data (e.g., of a human body part) to the processing device 1330 without first processing the data. In either instance, the processing device 1330 may use the sensor circuitry 1335 to process and/or interpret the received data. If data is received from multiple sensors, processing the data may include averaging the data, identifying a maximum from the data, or otherwise combining the data from the multiple sensors.

The preceding description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of the present invention.

In the above description, numerous details are set forth. It will be apparent, however, to one of ordinary skill in the art having the benefit of this disclosure, that embodiments of the invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "determining", "identifying", "adding", "selecting" or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the invention also relate to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A mobile computing device comprising:

a first antenna to send and receive radio frequency (RF) signals at 2.4 gigahertz (GHz) and at 5 GHz;

a second antenna to send and receive RF signals at 2.4 GHz and at 5 GHz;

a conductive element in proximity to the first and the second antennas, the conductive element causing signal coupling between the first and the second antennas via an over-the-air signal path when the first and the second antennas are operating at 2.4 GHz, wherein a first signal along the over-the-air signal path has a first phase;

a first reactive component coupled between the first antenna and the second antenna, wherein the first reactive component comprises a shunt circuit comprising at least one of a capacitor or an inductor; and a first band-pass filter circuit coupled in series with the first reactive component, wherein the first band-pass filter circuit and the first reactive component together form a signal path for a second signal to flow between the first and the second antennas when the first and the second antennas are operating at 2.4 GHz, the second signal having a second phase that is 180 degrees offset from the first phase, and wherein the first band-pass filter circuit disables signal flow between the first and the second antennas when the first and the second antennas are operating at 5 GHz.

2. The mobile computing device of claim 1, further comprising:

a second reactive component coupled between the first antenna and the second antenna; and a second band-pass filter circuit coupled in series with the second reactive component, wherein the second band-pass filter circuit and the second reactive component together form a signal path for a third signal to flow between the first antenna and the second antenna when the first antenna and the second antenna are operating at 5 GHz, the third signal having a third phase that is 180 degrees offset from a fourth phase of a fourth signal along the over-the-air signal path when the first and the second antennas are operating at 5 GHz, and wherein the second band-pass filter circuit disables signal flow between the first and the second antennas when the first and the second antennas are operating at 2.4 GHz.

3. An apparatus comprising:

a first reactive component coupled between a first antenna and a second antenna in a multi-band antenna system, wherein the first reactive component comprises a shunt circuit comprising at least one of a capacitor or an inductor; and a first operation circuit coupled to the first reactive component, the first reactive component and the first operation circuit together forming a signal path to enable signal flow between the first and the second antennas when the first and the second antennas are operating at a first frequency and wherein the first operation circuit disables signal flow along the signal path when the first and the second antennas are operating at a second frequency.

4. The apparatus of claim 3, wherein a signal coupling between the first and the second antennas occurs via an over-the-air signal path when the first and the second antennas are operating at the first frequency, wherein a first signal along the over-the-air signal path has a first phase, and wherein a second signal along the signal path formed by the first reactive component and the first operation circuit has a second phase that is 180 degrees offset from the first phase.

5. The apparatus of claim 3, wherein the first reactive component and the first operation circuit are part of a same circuit and share at least one of a capacitor or an inductor.

6. The apparatus of claim 3, further comprising:

a first transmission line to couple the first reactive component to the first antenna; and a second transmission line to couple the first reactive component to the second antenna, wherein the first transmission line and the second transmission line have a same length.

7. The apparatus of claim 3, wherein the first frequency is lower than the second frequency, and wherein the first operation circuit comprises a low-pass filter.

8. The apparatus of claim 3, wherein the first frequency is higher than the second frequency, and wherein the first operation circuit comprises a high-pass filter.

9. The apparatus of claim 3, wherein the first operation circuit comprises at least one of a band-pass filter or a band-stop filter.

10. The apparatus of claim 3, wherein the first operation circuit comprises a switch.

11. The apparatus of claim 3, further comprising:

a second reactive component coupled between the first and the second antennas; and a second operation circuit coupled to the second reactive component, the second reactive component and the second operation circuit together forming a signal path to enable signal flow between the first and the second antennas when the first and the second antennas are operating at the second frequency and wherein the second operation circuit disables signal flow along the signal path when the first and the second antennas are operating at the first frequency.

12. A method comprising:

enabling, by a first operation circuit coupled to a first reactive component between a first antenna and a second antenna in a multi-band antenna system, signal flow between the first and the second antennas along a signal path formed by the first reactive component and the first operation circuit when the first and the second antennas are operating at a first frequency, wherein the first reactive component comprises a shunt circuit comprising at least one of a capacitor or an inductor; and disabling, by the first operation circuit, signal flow between the first and the second antennas along the signal path when the first and second antennas are operating at a second frequency different from the first frequency.

13. The method of claim 12, wherein a signal coupling between the first and the second antennas occurs via an over-the-air signal path when the first and the second antennas are operating at the first frequency, wherein a first signal along the over-the-air signal path has a first phase, and wherein a second signal along the signal path formed by the first reactive component and the first operation circuit has a second phase that is 180 degrees offset from the first phase.

14. The method of claim 12, wherein the first frequency is lower than the second frequency, and wherein the first operation circuit comprises a low-pass filter.

15. The method of claim 12, wherein the first frequency is higher than the second frequency, and wherein the first operation circuit comprises a high-pass filter.

16. The method of claim 12, wherein the first operation circuit comprises at least one of a band-pass filter or a band-stop filter.

17. The method of claim 12, wherein the first operation circuit comprises a switch.

18. The method of claim 12, further comprising:

enabling, by a second operation circuit coupled to a second reactive component between the first and the second antennas, signal flow between the first and the second antennas along a signal path formed by the second reactive component and the second operation circuit when the first and the second antennas are operating at the second frequency; and disabling, by the second operation circuit, signal flow between the first antenna and the second antenna and along the signal path when the first and the second antennas are operating at the first frequency.

* * * * *